US006600139B2

(12) United States Patent
Perschl et al.

(10) Patent No.: US 6,600,139 B2
(45) Date of Patent: Jul. 29, 2003

(54) APPLIANCE CONTROL PROTECTION APPARATUS

(75) Inventors: Franz Perschl, New Bern, NC (US); Manfred W. Staebler, New Bern, NC (US); Nils Platt, New Bern, NC (US)

(73) Assignee: BSH Home Appliances Corporation, Huntington Beach, CA (US)

( * ) Notice: Subject to any disclaimer, the term of this patent is extended or adjusted under 35 U.S.C. 154(b) by 52 days.

(21) Appl. No.: 09/885,328

(22) Filed: Jun. 19, 2001

(65) Prior Publication Data

US 2002/0190055 A1 Dec. 19, 2002

(51) Int. Cl.[7] ..... H05B 3/68
(52) U.S. Cl. ..... 219/460.1
(58) Field of Search ..... 219/445.1, 446.1, 219/448.11, 448.12, 451.1, 452.11, 452.12, 460.1, 461.1, 465.1, 466.1; 126/39 H, 39 J, 39 K, 90 A, 92 AC, 92 A

(56) References Cited

U.S. PATENT DOCUMENTS

| | | | | |
|---|---|---|---|---|
| 3,663,798 A | | 5/1972 | Speidel et al. | |
| 3,838,505 A | | 10/1974 | Doner | |
| 3,859,499 A | | 1/1975 | Evans et al. | |
| 3,870,862 A | | 3/1975 | Doner | |
| 4,191,875 A | | 3/1980 | Cunningham | |
| 4,511,781 A | * | 4/1985 | Tucker et al. | 219/926 |
| 4,549,052 A | | 10/1985 | Simon | |
| 4,608,962 A | * | 9/1986 | Ng | 219/452.12 |
| 4,951,646 A | | 8/1990 | Diekmann et al. | |
| 4,983,799 A | | 1/1991 | Bonnet et al. | |
| 5,155,338 A | * | 10/1992 | Hoffmann | 219/445.1 |
| 5,357,080 A | * | 10/1994 | Vetter et al. | 219/445.1 |
| 5,422,460 A | | 6/1995 | Bralia et al. | |
| 5,711,606 A | | 1/1998 | Koether | |
| 5,831,847 A | * | 11/1998 | Love | 361/695 |
| 6,087,637 A | * | 7/2000 | Fischer et al. | 219/465.1 |

* cited by examiner

*Primary Examiner*—Sang Paik
(74) *Attorney, Agent, or Firm*—John T. Winburn

(57) ABSTRACT

An appliance control protection apparatus for a glass ceramic cooktop is constructed with a double wall housing and a low voltage cooling fan. The double wall housing is comprised of a first inner wall and a outer wall and prevents the transfer of heat from the heating elements in a glass ceramic cooktop towards the electronic control unit. The first inner wall is adhered to the underside of the ceramic glass panel of the cooktop and the outer wall snaps into position over the first wall, resulting in a space therebetween for insulation. Additionally, the control housing is provided with a low voltage fan that convects heat away from hot spots formed on the electronic control unit toward other components within the control housing. The low voltage fan operates in response to certain operating temperatures within the control housing as detected by a heat sensor.

13 Claims, 2 Drawing Sheets

APPLIANCE CONTROL PROTECTION APPARATUS

BACKGROUND OF THE INVENTION

1. Field of the Invention

The present invention relates to an apparatus for protecting appliance controls for glass ceramic cooktops by providing double wall insulation and a low voltage fan.

2. Background Art

Dividing walls in cooktop appliances for control protection are generally known in the art. For example, U.S. Pat. No. 3,870,862 discloses a cooktop structural wall dividing the space below the cooktop into a cooking space portion and control space portion. The control space portion houses the electronic control components of the cooktop. The divider wall extends between a front sidewall and a rear sidewall below the cooktop and includes a pair of mounting bosses aligned with similar bosses on a left sidewall. The divider wall, the left sidewall and portions of the front sidewall and the rear sidewall surrounds the control space portion of the glass-ceramic cooktop. Unfortunately, the divider wall provides minimal insulating capabilities and is costly to assemble with the rest of the cooktop assembly.

Air flow systems have been generally utilized for control protection purposes. For example, U.S. Pat. No. 3,859,499 discloses an air flow system for heat-cleaning ranges in which room air is drawn through air inlets located along the sides and top of an oven opening. The air passes through a space between the range outer casting and the inner oven cabinet. A blower draws air into the upper air flow passageway during an oven heat-cleaning cycle. The blower exhausts air to the atmosphere through a vented splash panel.

U.S. Pat. No. 4,983,799 discloses a ventilation circuit for cooling the electronic power system of a domestic appliance. The circuit includes a fan mounted in the vicinity of the rear wall of the appliance housing. The ventilation circuit is shaped in order to force air in a direction substantially parallel to the electronic power system. The bottom of the housing has a port which is arranged vertically in line with the ventilation space. Air is forced through the port and into the housing and is subsequently removed by suction.

In U.S. Pat. No. 4,191,875, a fan for circulating air through a induction cooktop housing and maintaining the temperature of the electronic components is disclosed. The fan includes a conventional electronic motor used to circulate air both in and out of the housing through various openings provided in the housing. The speed of the electric fan is proportional to the degree of induction heating of the heating elements. The conventional electronic motor used in the fan requires substantial voltage and is bulky. U.S. Pat. No. 4,549,052 discloses a cooling system for an induction cooking cartridge. The system includes an internal fan for cooling the various induction heating components. The cooking cartridge is constructed so that a unique air flow enters a mounting recess in at least two areas and enters a cartridge cavity at the bottom and the top. The air flow is directed over the induction heating circuitry for cooling and is exhausted through the fan to an exhaust conduit.

U.S. Pat. No. 4,951,646 discloses a blower for a ventilated glass-top cooking unit. Control equipment is mounted in a lower compartment of the cooktop housing along with a blower having an intake in the lower compartment and an outlet in a vent passageway. The blower draws a primary stream of air in from the front of the housing and through the lower compartment and expels it upward into the vent passageway. This current aspirates secondary streams of air from the upper and intermediate compartments by venturi action. As a result, the electronic control equipment in the lower compartment is actively cooled by incoming outside air. Unfortunately, the blower is always on during cooking and is therefore susceptible to burnout.

SUMMARY OF THE INVENTION

The present invention overcomes the above-mentioned disadvantages by providing an appliance control protection apparatus for glass ceramic cooktop which includes a double wall housing that is inexpensive to assemble and provides superior insulating capabilities. According to the invention, the electronic control unit, including the circuit boards, are confined within a double wall housing. The first inner wall is adhered to the underside of the ceramic glass panel of the cooktop. The outer wall snaps into position over the first wall and provides a spacing therebetween which may also be filled with insulating material to prevent transfer of the heat from the heating elements in the cooktop toward the electronics.

Another advantage of the present invention is an appliance control protection apparatus for a glass ceramic cooktop which includes a low voltage fan and a heat sensor. The electronic control unit in a glass ceramic cooktop contains components, such as relays and transformers, that create hot spots within the control housing. The fan is mounted within the control housing to dissipate heat without ducting. Preferably, the fan responds to the formation of hot spots, as detected by a heat sensor, by convecting the heat away from the hot spots toward other components within the control housing, only operating when a predetermined temperature level of a hot spot is recorded. The fan operates conveniently to distribute heat evenly due to its compact size. Moreover, the fan does not require the power consumption of previously known fans.

DETAILED DESCRIPTION OF THE PREFERRED EMBODIMENT(S)

Figure 1:
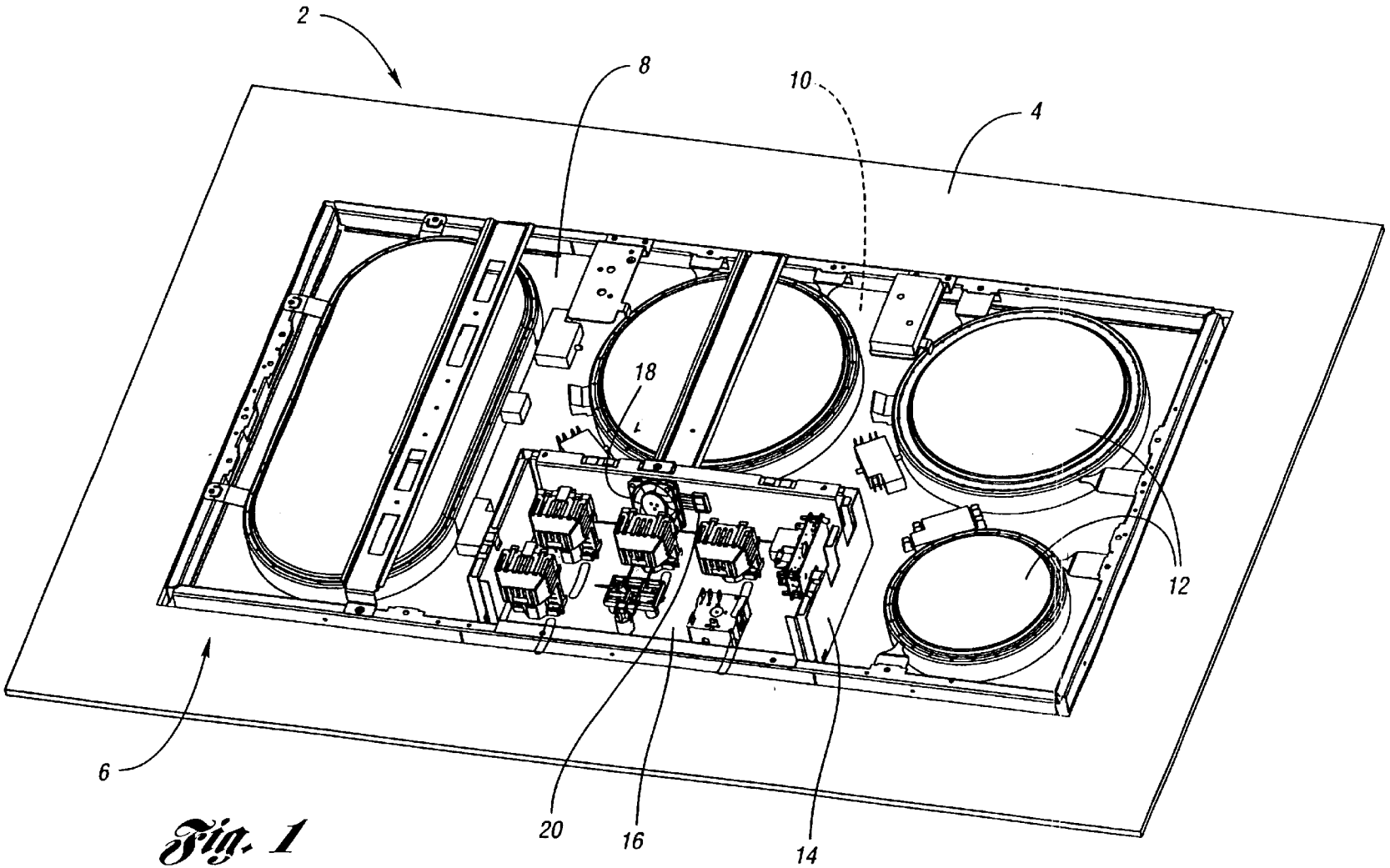
FIG. 1 is a perspective view of the underside of a glass ceramic cooktop containing an appliance control protection apparatus of the current invention.

As seen in FIG. 1, glass ceramic cooktop 2 having frame 4 and glass ceramic panel 6 is shown from a perspective of below glass ceramic cooktop 2. Frame 4 is constructed from high-grade steel or any other material that has suitable thermal and strength characteristics. Glass ceramic panel 6 of cooktop 2 is secured within frame 4 and has underside 8 and exposed side 10. Individual heating elements 12 and control housing 14 are affixed to underside 8 of glass ceramic panel 6. Electronic control unit 16 is isolated from individual heating elements 12 by control housing 14, and contains electronic components, such as relays and transformers. Low voltage fan 18 and heat sensor 20 is situated within control housing 14.

Figure 2:
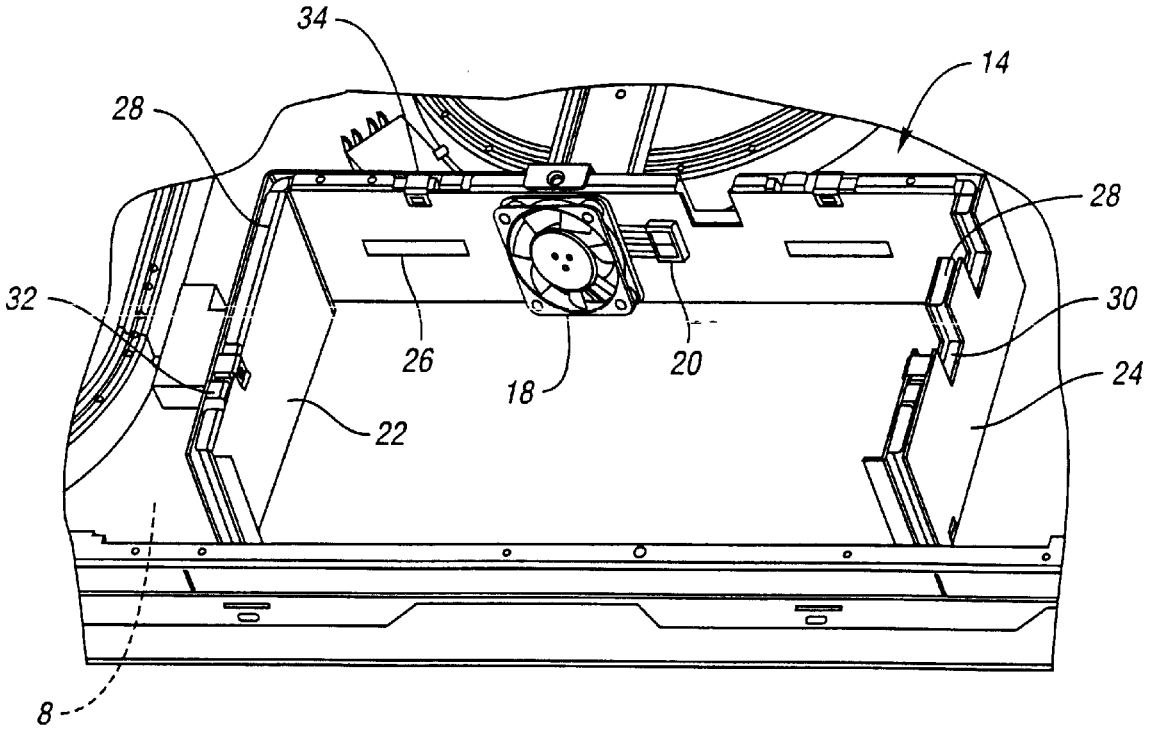
FIG. 2 is a perspective view of an appliance control protection apparatus of the current invention.

Looking at FIGS. 1 and 2, FIG. 2 shows an exploded perspective view of control housing 14, fitted with low voltage fan 18 and heat sensor 20 in the vicinity of heating elements 12. It is understood that low voltage fan 18 can be affixed anywhere within control housing 14. Control housing 14 is comprised of first inner wall 22 and outer wall 24. First inner wall 22 is adhered to underside 8 of glass ceramic panel 6 of cooktop 2. Glue adheres first inner wall 22 to underside 8 of glass ceramic panel 6 of cooktop 2. The glue provides a superior moisture barrier between electronic control unit 16 and heating elements 12. First inner wall 22 is constructed from sheet metal or any other material with suitable thermal characteristics. In a preferred embodiment, first inner wall 22 includes slotted openings 26 to accommodate support brackets on other cooktop structural elements. First inner wall 22 also includes flanges 28 which aid in containing insulating material 30 between first inner wall 22 and outer wall 24. Outer wall 24 snaps into position over flaps 32 provided in first inner wall 22. In a preferred embodiment, no gluing is necessary to attach outer wall 22 to first inner wall 20. The snap-in design is easy to assemble and does not require the use of extra fasteners, such as screws or rivets. Outer wall 22 is constructed from sheet metal or any other material with suitable thermal characteristics. Outer wall 22 includes flanges 34 which aid in guiding outer wall 24 into place and continuing insulating material 30 between first inner wall 22 and outer wall 24. The positioning of outer wall 24 over first inner wall 22 creates a spacing therebetween which may be filled with insulating material 30 to prevent transfer of the heat from the heating elements in the cooktop toward the electronics. A particularly suitable insulation material 30 is mineral wool, although other materials can be similarly utilized.

Figure 3:
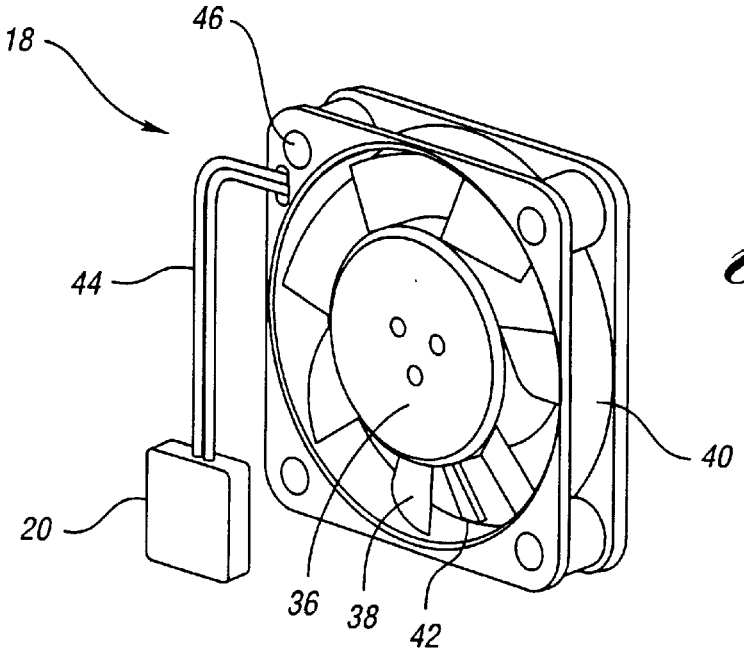
FIG. 3 is a perspective view of a low voltage fan of the current invention.

Referring to FIGS. 1, 2 and 3, FIG. 3 shows an exploded view of low voltage fan 18 and heat sensor 20. Low voltage fan 18 is comprised of low voltage motor (not shown), motor housing 36, fan blades 38, frame 40, bracket 42, and power cord 44. Preferably, low voltage fan 18 is a direct circuit fan that running at voltage lower than a standard 120 volt AC/DC fan. In a preferred embodiment, the voltage of the low voltage fan may be in a range of 10 to 40 volts. Low voltage motor is encased in motor housing 36 and is connected to power cord 44. Fan blades 38 are attached circumferentially around the perimeter of motor housing 36. The combination of fan blades 38 and motor housing 36 is positioned within frame 40 and held in position by bracket 42. Frame 40 has apertures 46 at each corner set to receive fasteners that affix low voltage fan 18 to first inner housing 22. Preferably, heat sensor 20 is attached to power cord 36 and controls the supply of power for low voltage fan 18. When heat sensor 20 senses a temperature which may result in damage to electronic control unit 16, low voltage fan 18 begins to operate. Since the temperature within control housing 14 will only reach a damaging temperature on rare occasion, low voltage fan 18 will operate sparingly. Low voltage fan 18 convects heat away from hot spots created by electronic components, such as relays and transformers, of electrical control unit 16 towards other components. Low voltage fan 18 effectively distributes the heat within control housing 14 evenly without the need for any ventilation passages. Additionally, low voltage fan 18 is small in outside dimension as compared to its large AC/DC fan counterparts. As a result, low voltage fan 18 can operate within control housing 14 without ducting to distribute heat evenly, while requiring less power consumption than previously known fans. Moreover, low voltage fan makes minimal noise as compared to AC/DC fans.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An appliance with control protection apparatus for a glass ceramic cooktop comprising:

a) a glass ceramic cooktop panel having an exposed side and an underside;

b) a set of heating elements affixed to said underside of said glass ceramic cooktop panel;

c) an electronic control unit affixed to said glass underside of said ceramic cooktop panel;

d) a first inner wall adhered to said underside of said ceramic cooktop panel, wherein said first inner wall isolates said electronic control unit from said set of heating elements;

e) an outer wall snapped into position over said first inner wall; and f) a spacing provided between said first inner wall and said outer wall.

2. The appliance with control protection apparatus of claim 1 further comprising an insulating material inserted into said spacing, wherein said insulating material prevents the transfer of heat from said set of heating elements toward said electronic control unit.

3. The appliance with control protection apparatus of claim 2 wherein said insulating material is air.

4. The appliance with control protection apparatus of claim 2 wherein said insulating material is mineral wool.

5. The appliance with control protection apparatus of claim 1 wherein said first inner wall is constructed of sheet metal.

6. The appliance with control protection apparatus of claim 1 wherein said outer wall is constructed of sheet metal.

7. The appliance with control protection apparatus of claim 1 wherein said first inner wall is adhered with a glue, wherein said glue provides a moisture barrier between said set of heating elements and said electronic control unit.

8. An appliance control protection apparatus for a glass ceramic cooktop panel with an electronic control unit affixed to beneath the panel, the control protection apparatus comprising:

a) a first inner wall adhered beneath the ceramic cooktop panel, wherein said first inner wall isolates the electronic control unit;

b) an outer wall snapped into position over said first inner wall; and c) a spacing provided between said first inner wall and said outer wall.

9. The appliance control protection apparatus of claim 8 further comprising an insulating material inserted into said spacing, wherein said insulating material prevents the transfer of heat from the electronic control unit.

10. An appliance with control protection apparatus for a glass ceramic cooktop comprising:

a) a glass ceramic cooktop panel having an exposed side and an underside;

b) a set of heating elements affixed to said underside of said glass ceramic cooktop panel;

c) an electronic control unit affixed to said underside of said glass ceramic cooktop panel;

d) a control housing air flow barrier isolating said electronic control unit from said set of heating elements;

e) a heat sensor positioned within said control housing; and f) a low voltage fan positioned within said control housing, wherein said low voltage fan operates in response to said heat sensor and wherein said low voltage fan convects and dissipates heat away from hot spots of said electronic control unit.

11. The appliance with control protection apparatus of claim 10 wherein said heat sensor is adjacent to said set of heating elements.

12. An appliance control protection apparatus for a glass ceramic cooktop panel with an electronic control unit affixed to beneath the panel, the control protection apparatus comprising:

a) a control housing air flow barrier isolating air flow from the electronic control unit;

b) a heat sensor positioned within said control housing; and c) a low voltage fan positioned within said control housing, wherein said low voltage fan operates in response to said heat sensor and wherein said low voltage fan convects and dissipates heat away from hot spots of said electronic control unit.

13. The appliance control protection apparatus of claim 12 wherein said heat sensor is adjacent to said electronic control unit.

* * * * *